US010285567B2

(12) United States Patent
Krause et al.

(10) Patent No.: US 10,285,567 B2
(45) Date of Patent: May 14, 2019

(54) DISH SCRUBBER WITH CHANGEABLE SCRUB HEAD

(71) Applicant: Scrub Daddy, Inc., Folcroft, PA (US)

(72) Inventors: Aaron C. Krause, Voorhees, NJ (US); Aleksandrs Titovs, Folcroft, PA (US)

(73) Assignee: Scrub Daddy, Inc., Folcroft, PA (US)

( * ) Notice: Subject to any disclaimer, the term of this patent is extended or adjusted under 35 U.S.C. 154(b) by 147 days.

(21) Appl. No.: 15/653,671

(22) Filed: Jul. 19, 2017

(65) Prior Publication Data

US 2019/0021574 A1 Jan. 24, 2019

(51) Int. Cl.

| | |
|---|---|
| ***A47L 17/04*** | (2006.01) |
| ***A46B 11/00*** | (2006.01) |
| ***A46B 5/00*** | (2006.01) |

(52) U.S. Cl.

CPC ..... *A47L 17/04* (2013.01); *A46B 5/0054* (2013.01); *A46B 11/0013* (2013.01); *A46B 2200/3033* (2013.01)

(58) Field of Classification Search

CPC ..... A47L 17/00–04; A46B 11/001; A46B 11/0013; A46B 11/002; A46B 11/0041; A46B 11/0062; A46B 11/0065; A46B 5/00–0054; A46B 5/0095; A46B 7/04; A46B 7/044; A46B 7/046; A46B 7/048; A46B 2200/3033

See application file for complete search history.

(56) References Cited

U.S. PATENT DOCUMENTS

| | | | | |
|---|---|---|---|---|
| 1,456,977 | A * | 5/1923 | Geib | A46B 11/063 15/229.2 |
| 1,513,339 | A | 10/1924 | Merrihew | |
| 2,276,889 | A | 3/1942 | Stark | |
| 3,056,997 | A | 10/1962 | Cummings | |
| 5,890,254 | A * | 4/1999 | Courtney | A46B 17/02 15/145 |
| 6,412,997 | B2 * | 7/2002 | Berke | A45D 34/04 401/138 |
| 7,461,993 | B1 | 12/2008 | Sampaio | |
| D598,202 | S | 8/2009 | McNeil et al. | |
| D599,114 | S * | 9/2009 | Hinnant | D4/114 |
| 7,984,528 | B2 * | 7/2011 | Giacolo | B25G 3/08 15/145 |
| D657,570 | S * | 4/2012 | Mahiques | D4/124 |
| D660,006 | S | 5/2012 | Li | |
| D765,989 | S * | 9/2016 | Garcia Mahiques | D4/116 |

(Continued)

*Primary Examiner* — David J Walczak
*Assistant Examiner* — Randall A Gruby
(74) *Attorney, Agent, or Firm* — Norman E. Lehrer

(57) ABSTRACT

A dish scrubbing brush includes an elongated handle and a brush head adapted to be releasably attached to the top of the handle. A hollow reservoir located within the handle contains liquid soap. An orifice at the top of the handle communicates with the brush head when it is attached and a pump accessible from the exterior of the handle forces soap from the reservoir to the brush head. The brush head includes a foam brush and an adapter for securing the brush head to the top of the handle. The adapter includes an internal thread that cooperates with a partial external thread on the handle top and includes a rib that cooperates with a slot in the handle top. As the adapter is rotated to be attached to the handle, the brush is drawn toward the handle but does not rotate relative thereto.

5 Claims, 2 Drawing Sheets

(56) References Cited

U.S. PATENT DOCUMENTS

| | | | | | |
|---|---|---|---|---|---|
| D811,674 | S | * | 2/2018 | Krause | D32/40 |
| D822,298 | S | * | 7/2018 | Krause | D32/43 |
| D822,927 | S | * | 7/2018 | Krause | D32/43 |
| 2014/0345074 | A1 | | 11/2014 | Lee | |
| 2018/0235354 | A1 | * | 8/2018 | Lee | A46B 5/0095 |

* cited by examiner

DISH SCRUBBER WITH CHANGEABLE SCRUB HEAD

BACKGROUND OF THE INVENTION

The present invention is directed toward a scrubbing device primarily intended to be used in a kitchen for scrubbing pots and pans, dishes and the like and, more particularly, toward such a scrubbing device that has changeable scrub heads.

Dish scrubbing brushes have been around for a long time and come in a variety of shapes and sizes. Traditionally, they include an elongated handle with a bristle brush at the end. See, for example, U.S. Pat. Nos. 1,513,339; 2,276,889 and D598,202. In lieu of bristles, some dishwashing or scrubbing brushes have used foam heads. Design Patent No. D660,006 appears to show such a brush. The entire contents of each of these prior patents are incorporated herein by reference.

It has also been known to provide a reservoir in the handle of a dishwashing brush for holding a supply of liquid dishwashing soap or detergent. The soap can be dispensed from the handle portion into the brush portion through an opening between them. See, for example, U.S. Pat. Nos. 3,056,997 and 7,461,993. In many cases, a built-in pump mechanism forces the soap from the handle portion to the brush portion when the handle is squeezed or a button or the like is depressed on the handle portion. The entire contents each of these prior patents are also incorporated herein by reference.

Over time and after many uses dishwashing or dish scrubbing brushes wear out and have to be replaced. It is normally the brush portion that wears out first. But with most prior art dish scrubbing brushes, it is impossible to replace only the brush head. As a result, the entire brush must be discarded and replaced.

In addition, there may be times when different brush heads may be needed for different jobs. For example, a small head may be needed to get into drinking glasses or the like while a larger head may be desirable for larger dinner plates. Similarly, a soft brush head may be needed when cleaning fine china while a much more rigid and coarse brush head might be desirable when scrubbing pots and pans. Again, however, with most prior art dishwashing or dish scrubbing brushes, it is impossible to change the brush head. As a result, a homeowner or other person responsible for washing pots, pans and dishes, must possess a number of different size, shape and texture dish scrubbing brushes.

To Applicants' knowledge, there has never been a dish scrubbing brush that includes a reservoir handle and the ability to quickly and easily change the brush head. There is, therefore, believed to be a need for such a dish scrubbing brush.

SUMMARY OF THE INVENTION

The present invention is designed to overcome the deficiencies of the prior art discussed above. It is an object of the present invention to provide a dish scrubbing brush with a brush head that is easily and quickly removed or changed when desired.

In accordance with the illustrative embodiment demonstrating features and advantages of the present invention, there is provided a dish scrubbing brush that includes an elongated handle and a brush head adapted to be releasably attached to the top of the handle. A hollow reservoir located within the handle contains liquid soap. An orifice at the top of the handle communicates with the brush head when it is attached and a pump accessible from the exterior of the handle forces soap from the reservoir to the brush head. The brush head includes a foam brush and an adapter for securing the brush head to the top of the handle. The adapter includes an internal thread that cooperates with a partial external thread on the handle top and includes a rib that cooperates with a slot in the handle top. As the adapter is rotated to be attached to the handle, the brush is drawn toward the handle but does not rotate relative thereto. A removable cap at the bottom of the handle allows for refilling of the reservoir.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
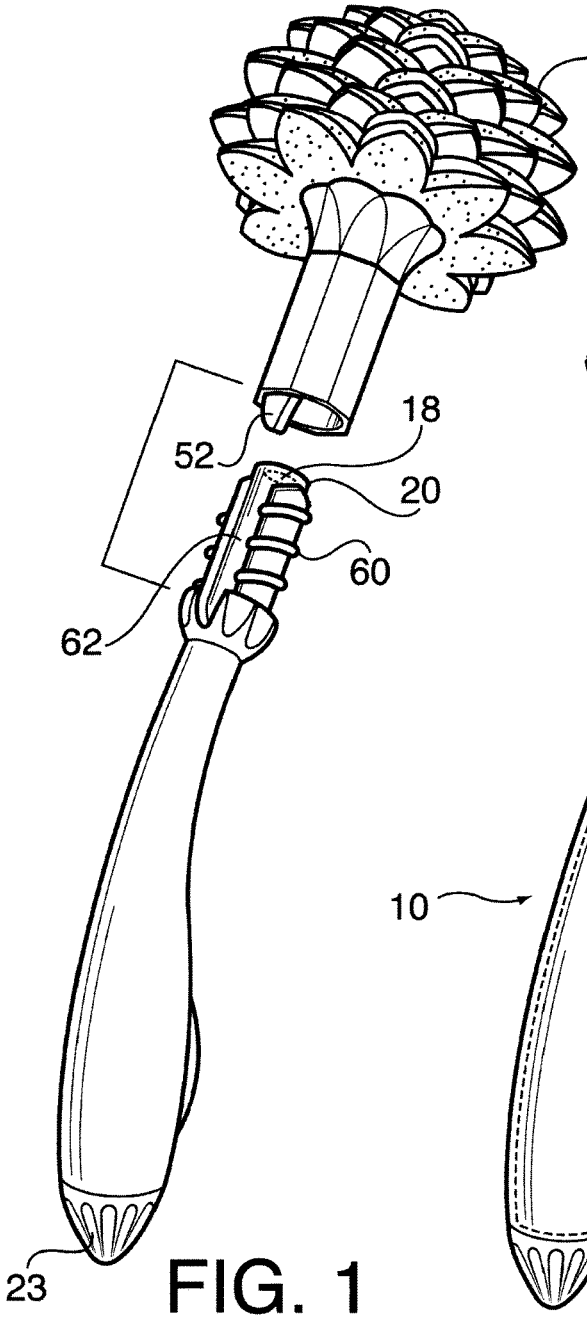
FIG. 1 is a perspective view of a dish scrubbing brush with a changeable head in accordance with our invention.
Figure 2:
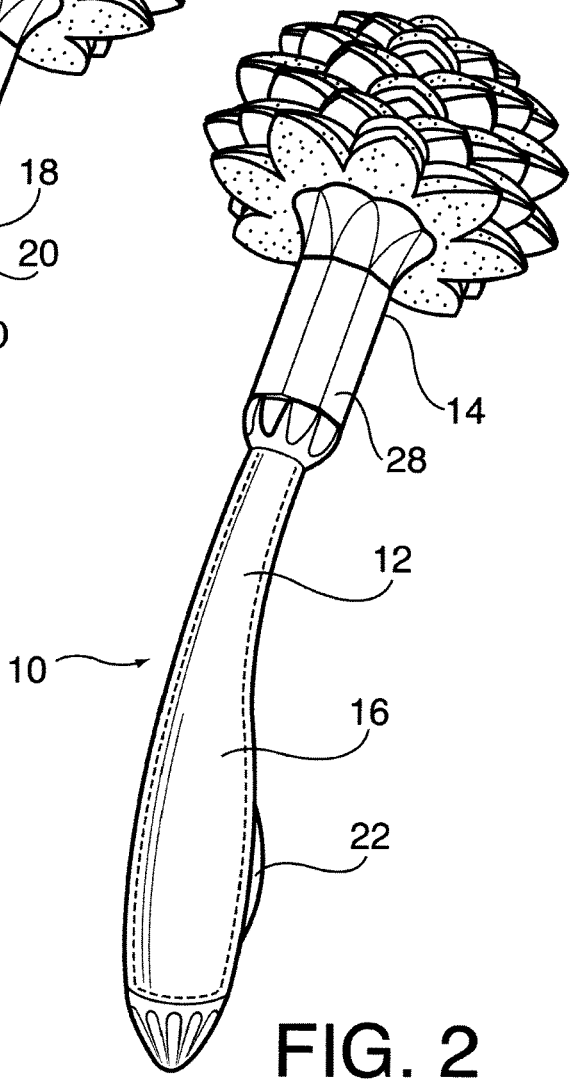
FIG. 2 is a view similar to FIG. 1 but showing the handle and head detached from each other.

Referring now to the drawings in detail wherein like reference numerals have been used throughout the various figures to designate like elements, there is shown in FIGS. 1 and 2 a dish scrubbing brush with a changeable brush head constructed in accordance with the principles of the present invention and designated generally as 10. The dish scrubbing brush 10 essentially includes a handle portion 12 and a brush head 14.

The handle portion 12 includes a hollow reservoir 16 therein adapted to contain a quantity of liquid dishwashing soap. The reservoir 16 is preferably in the form of a compressible bladder. An orifice 18 at the top 20 of the handle portion 12 provides a passageway or communications between the reservoir 16 and the brush head 14 when the brush head 14 is attached to the handle portion 12 as shown in FIG. 1.

A push button 22 accessible from the exterior of the handle portion 12 is adapted to press on the reservoir bladder 16 when the button is depressed to force the liquid soap through the orifice 18 into the brush head 14. The cap 23 at the bottom end of the handle portion 12 can be removed when it is desired to refill the reservoir with liquid soap. The reservoir 16, button 22, removable cap 23 and the passageway leading to the orifice 18 are, per se, known in the art. They can be constructed and operate in essentially the same manner as the handles shown in U.S. Pat. Nos. 3,056,997 and 7,461,993, the entire contents of which are incorporated herein by reference.

The brush head 14 includes a brush 24 for cleaning dishes or pots and pans or the like and can be comprised of bristles or foam similar to other brushes known in the art. It is preferred, however, to construct at least a significant part of the brush 24 from a foam material that is rigid in cold water but soft in hot water. Such material is described, for example, in U.S. Patent Application Publication No. 2014/0075699.

The brush head 14 also includes an adapter 26 which is intended to connect the brush 24 to the top end 20 of the handle portion 12. As will be described and will be apparent to those skilled in the art, the adapter 26 can be threaded onto the top end 20 of the handle portion 12 and as the outer ring 28 is rotated, the brush 24 is drawn toward the handle portion but does not rotate relative thereto.

Figure 4:
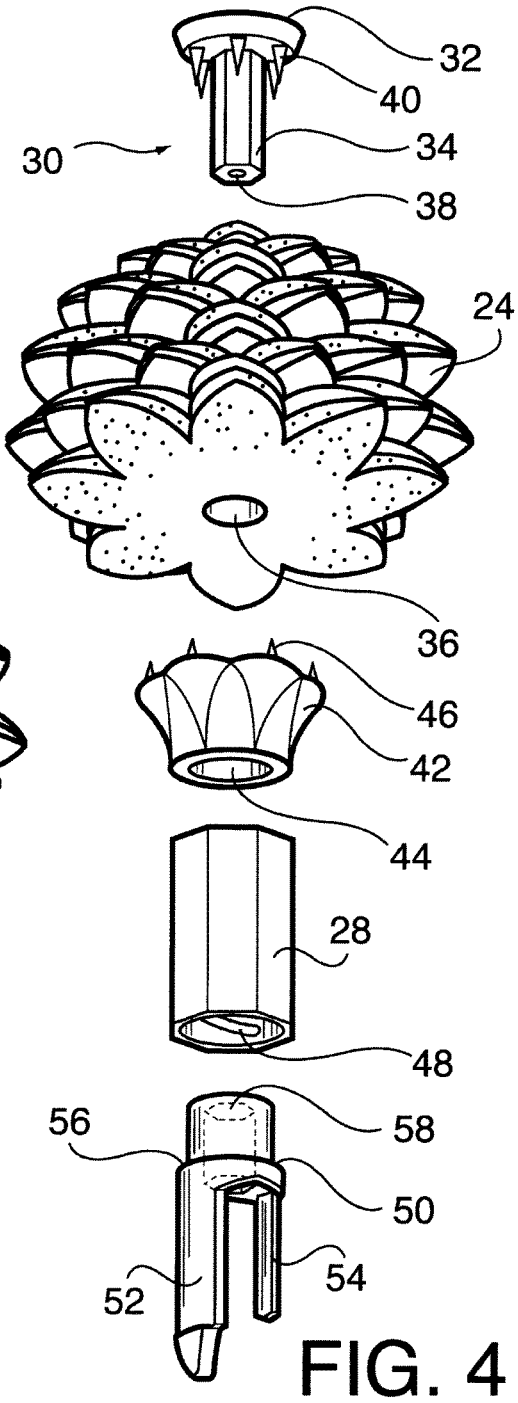
FIG. 4 is an exploded view of the brush head of FIG. 3.

As shown most clearly in FIG. 4, the adapter 26 is comprised of several component parts that are assembled together. The uppermost part 30 includes an upper disk-like flange 32 and a downwardly extending rod 34 that is adapted to pass downwardly through the opening 36 in the brush 24. The rod 34 includes an opening 38 that passes entirely therethrough. Also extending downwardly from the flange 32 is a plurality of prongs 40. The prongs 40 are adapted to engage and enter the top surface of the foam brush 24 to hold the same in place.

Below the brush 24 is a spacer 42 having an opening 44 passing therethrough. Extending upwardly from the spacer 42 is a plurality of prongs 46. The prongs 46 are adapted to engage and enter the bottom surface of the foam brush 24 to hold the same in place along with the prongs 40. Below the spacer 42 is the outer cylindrically shaped ring 28 mentioned above. The inside of the ring 28 is substantially open throughout its length but includes a series of interior screw threads such as shown at 48 in FIGS. 3 and 4.

An insert 50, having spaced apart downwardly extending ribs 52 and 54, fits upwardly into the ring 28. The insert 50 includes a ledge 56 which cooperates with a cooperating ledge or stop member on the inside of the ring 28 to prevent the insert from passing entirely through the ring. More correctly, when properly assembled, the ring 28 cannot pass downwardly over the insert 50. Passing entirely through the center of the insert 50 is a passageway or opening 58.

Figure 3:
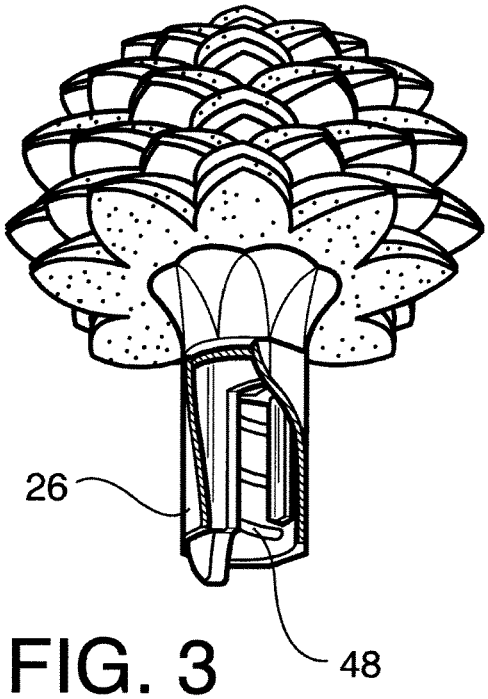
FIG. 3 is an elevational view of the brush head of our invention with a portion broken away for clarity.

To assemble the brush head 14, the insert 50 is moved upwardly into the ring 28. The uppermost part 30 is moved downwardly with the hollow rod 34 passing through the opening 36 in the sponge 24, through the opening 44 in the spacer 28 and into the opening 58 in the insert 50. The outer dimension of the rod 34 and the inner dimension of the opening 58 are chosen so that the rod is force fitted into the opening. If necessary, an adhesive can be used to ensure that the rod 34 remains tightly in the opening 58. When the brush head 14 is fully assembled, it appears as shown in FIGS. 1, 2 and 3.

The upper end 20 of the handle portion 12 includes a series of partial external screw threads 60 that are designed to cooperate with the threads 48 formed on the interior of the ring 28. Interrupting the screw threads 60 are a pair of elongated substantially linear slots. Only one slot 62 is shown in FIG. 1. The other of the slots is not shown but is preferably located 180° from the slot 62. The slots are intended to be complementary to the ribs 52 and 54.

When it is desired to attach a brush head 14 to the handle portion 12, the adapter 26 is moved into position over the upper end 20 with the ribs 52 and 54 oriented to be in alignment with the corresponding slots 60 in the upper end. The ring 28 is then rotated and the external threads 60 engage the internal threads 48. As rotation of the ring 28 continues, the brush head 14 and the handle portion 12 are drawn toward each other but they do not rotate relative to each other. Turning of the ring continues until the opening 18 at the top 20 of the handle portion engages the lower part of the opening 58 in the insert 50. The brush head 14 is removed by reversing the above process. In this way, various brush heads can be provided for various cleaning purposes and can be changed whenever desired.

As should be readily apparent to those skilled in the art, when the brush head 14 is assembled on the handle portion 12, there is a complete communications or passageway between the reservoir 16 and the top of the brush 24. Thus, when the button is depressed, liquid soap leaves the reservoir and passes through the handle portion 12 and brush 24 to the upper surface thereof for cleaning purposes.

The present invention may be embodied in other specific forms without departing from the spirit or essential attributes thereof and accordingly, reference should be made to the appended claims rather than to the foregoing specification as indicating the scope of the invention.

We claim:

1. A dish scrubbing brush with a changeable head comprising: an elongated handle portion having a top end and a bottom end and a brush head adapted to be releasably attached to said top end of said handle portion;

said handle portion including a hollow reservoir therein adapted to contain a quantity of a liquid soap, said handle portion further having an orifice at the top thereof providing a passageway from said reservoir to said brush head when said brush head is attached to said handle portion and further including means accessible from the exterior of said handle portion for forcing liquid soap from said reservoir through said passageway;

said brush head including a brush for scrubbing dishes and the like and an adapter for securing said brush head to said top end of said handle portion, said adapter being so constructed and arranged such that said adapter can be threaded onto said top end and as said adapter is rotated for attaching said brush head to said handle, said brush is drawn toward said handle but does not rotate relative thereto;

wherein said top end of said handle portion includes a partial external thread and a substantially elongated linear slot and wherein said adapter includes an elongated rib adapted to ride in said slot to prevent rotation of said brush as a portion of said adapter is rotated.

2. The dish scrubbing brush with a changeable head as claimed in claim 1 wherein said handle portion includes a removable cap at said bottom end for refilling said reservoir.

3. The dish scrubbing brush with a changeable head as claimed in claim 1 wherein said adapter includes an external cylindrical ring having an interior thread adapted to cooperate with said external thread of said top of said handle portion, said cylindrical ring being freely rotatable relative to the remaining parts of said adapter.

4. The dish scrubbing brush with a changeable head as claimed in claim 3 wherein said cylindrical ring is incapable of linear movement relative to the remaining parts of said adapter.

5. The dish scrubbing brush with a changeable head as claimed in claim 1 wherein said adapter includes an orifice therein in communication with said orifice in said top of said handle to allow liquid soap to pass from said reservoir through said adapter and into said brush.

* * * * *